US005091833A

United States Patent [19]

Paniaguas et al.

[11] Patent Number: 5,091,833

[45] Date of Patent: Feb. 25, 1992

[54] ILLUMINATED FACE ELEMENTS AND KIT FOR MAKING AN ILLUMINATED FACE ON PUMPKINS AND THE LIKE

[76] Inventors: Joseph M. Paniaguas; Maureen J. Paniaguas, both of 2839 Teresa St., Portage, Ind. 46368

[21] Appl. No.: 737,447

[22] Filed: Jul. 29, 1991

[51] Int. Cl.[5] ..... F21L 11/00

[52] U.S. Cl. ..... 362/191; 362/234; 362/208; 362/252; 362/808; 446/100; 446/485

[58] Field of Search ..... 362/234, 122, 124, 191, 362/208, 252, 806, 808; 206/573; 446/100, 485

[56] References Cited

U.S. PATENT DOCUMENTS

| | | | |
|---|---|---|---|
| D. 267,210 | 12/1982 | Schwuchow | D3/66 |
| 396,252 | 1/1889 | Beidler | 40/540 |
| 848,938 | 4/1907 | Tyndall | 40/540 |
| 1,805,823 | 5/1931 | Heilweil | 446/392 |
| 2,019,516 | 11/1935 | Weinberg | 446/100 |
| 2,428,133 | 9/1947 | Yogan | 40/540 |
| 2,685,022 | 7/1954 | Root et al. | 362/191 |
| 3,210,884 | 10/1965 | Sharff et al. | 446/100 |
| 3,452,473 | 7/1969 | Convertine | 446/353 |
| 3,841,019 | 10/1974 | Lorenzo | 446/100 |
| 4,263,743 | 4/1981 | Hanson et al. | 446/329 |
| 4,322,004 | 3/1982 | Schwuchow | 206/575 |
| 4,934,940 | 6/1990 | Savery | 434/263 |

*Primary Examiner*—Stephen F. Husar
*Attorney, Agent, or Firm*—Richard G. Kinney

[57] ABSTRACT

A kit for creating a face on a head-like base such as a pumpkin to create a jack-o-lantern or the like. The kit includes a plurality of illuminating units, each of which has a battery and light bulb, and a plurality of largely translucent facial elements such as an eye, mouth, ear, etc. The facial elements are screwed into the illuminating unit to envelop and surround the light bulb so that light from the bulb's light is transmitted through the facial elements and emitted from the external surfaces of those elements. The assembly is configured so that the battery is housed in a spear-like pointed base which may be pushed into the head-like base and the light-emitting facial element thereby affixed to the outer surface of the head-like base. Other non-illuminated facial elements may supplement the illuminated ones. The translucent facial elements are interchangeable on the illuminating units so that the same unit can use different elements and the user can have different choices of elements. The translucent elements and base when assembled together enclose the electrical elements in a waterproof manner. The translucent elements have their outer surfaces coated with a light-reflecting coating so that light is emitted only on desired uncoated surface areas.

8 Claims, 2 Drawing Sheets

ILLUMINATED FACE ELEMENTS AND KIT FOR MAKING AN ILLUMINATED FACE ON PUMPKINS AND THE LIKE

FIELD OF THE INVENTION

The present invention relates to artificial face elements and a kit including such elements which can be used to create a face on a pumpkin or snowman or like base.

BACKGROUND OF THE INVENTION

It is part of the tradition and fun of Halloween to display jack-o-lanterns. Commonly and probably originally, such were made by cleaning out the soft pulp of a pumpkin, carving side openings representing at least eyes, nose and mouth, and placing inside the hollow pumpkin a burning candle to illuminate these openings and the pumpkin head. A similar tradition exists with snowmen, wherein a face is often made—perhaps originally using lumps of coal as the facial elements. In more modern times, "snowmen" are often made of styrofoam or other artificial material, and kits of decorative elements are provided as described in U.S. Pat. Nos. 3,841,019; 4,322,004; and Des. 267,210.

A jack-o-lantern made out of artificial material is shown in U.S. Pat. No. 396,252. Artificial pumpkin jack-o-lanterns are shown in U.S. Pat. Nos. 848,938 and 2,428,133. These latter have pumpkin face electric lights to replace the candles of older jack-o-lanterns. Doll or cartoon heads or skulls have been made with individual permanently affixed facial elements such as eyes or teeth with permanent means for electrically lighting them.

It is also known to provide replaceable facial elements into head-like structures such as the Mr. Potato-Head TM toy kits and as shown in U.S. Pat. Nos. 2,019,516; 3,210,884; and 3,452,473.

While artificial pumpkin jack-o-lanterns such as the aforementioned U.S. Pat. Nos. 848,938 and 2,428,133 patents are convenient, they do not allow for the individual expression of carving a natural pumpkin. Yet, carving natural pumpkins is a messy process involving the inconvenience of cleaning out the pumpkin seeds and soft pulp and, while allowing for individualizing of the face, allows little margin for error or changing of the position of carved features after made. If a child places the mouth at a "wrong" place, he or she cannot change its position. There thus exists a need for a device and kit which allows a natural pumpkin to be used without cleaning it and yet produces a similar effect to a carved and interior lighted pumpkin jack-o-lantern. There also exists a need for such an improvement which allows the rearrangement of facial elements.

SUMMARY OF THE INVENTION

A kit for creating a face on a head-like base, such as a pumpkin, made in accordance with the present invention includes a plurality of self-powered illuminated facial elements such as eyes, mouth or the like, each of which includes a means such as pointed projections for affixing them to a pumpkin or the like. The elements each contain a source of stored energy such as a battery and a light emitter such as a bulb and means for directing the light out of the facial elements so as to give a similar appearance to an interior lighted, natural carved, hollow pumpkin jack-o-lantern when use with a pumpkin. The kit preferably includes other non-illuminated facial elements, such as eyebrows, which also have means for affixing them to the pumpkin to aid in creating of a face thereon.

One feature of the invention allows means for affixing to allow for reuse and rearrangement so that the user can create a number of different faces on the same base and the kit kept for reuse on other occasions and other pumpkins as in later years. Preferably, the means for attachment allow the kit of parts of be used to decorate snowmen (artificial or real) and other bases so as to create unusual effects as illuminated eyes in a snowman.

Another feature of the present invention is the providing of interchangeable illuminated facial elements, such as eyes, ears, etc., so that the same light emitting and energy storage combination may be selectively used with any one of a large number of different facial elements.

The invention, together with further advantages and features thereof, may best be understood by reference of the following description taken in connection with the accompanying drawings, in the several figures of which like reference numerals identify like elements.

DETAILED DESCRIPTION OF ONE PREFERRED EMBODIMENT

Figure 1:
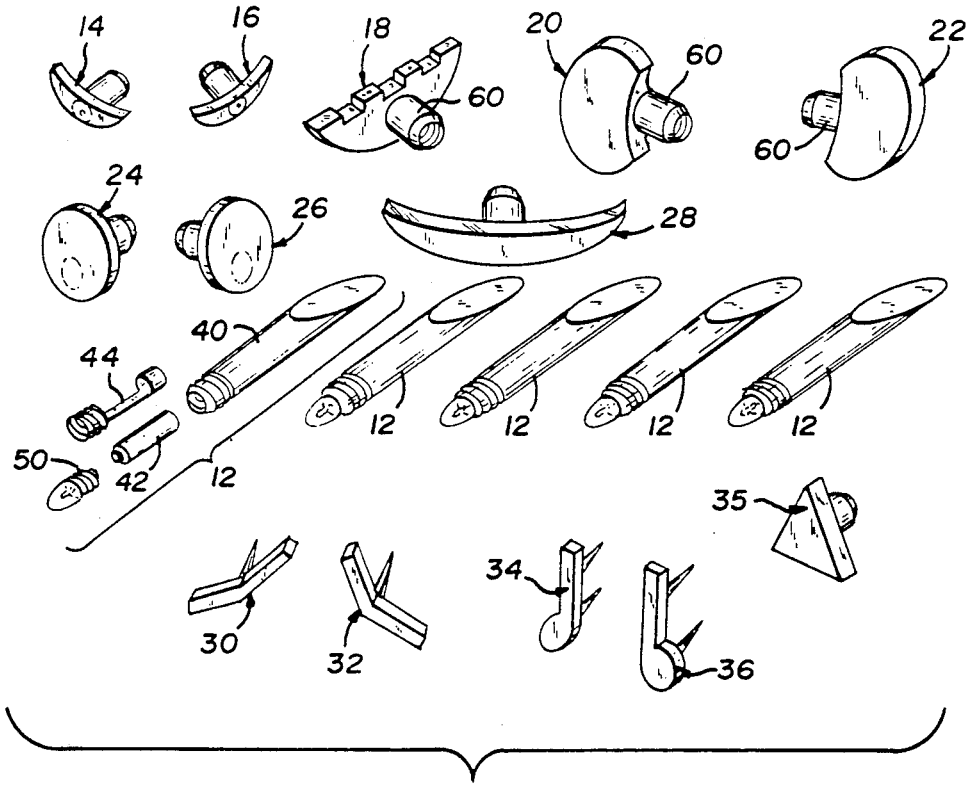
FIG. 1 is a perspective view of a kit of parts constructed in accordance with the present invention.
Figure 4:
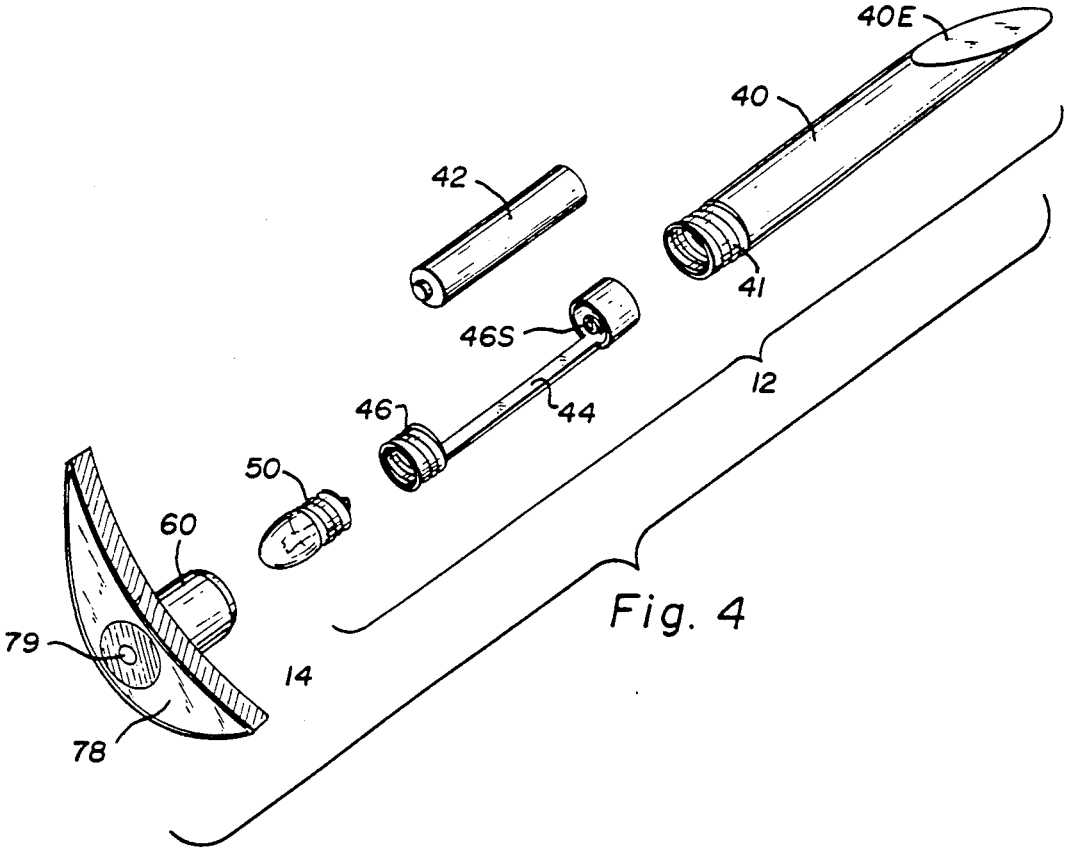
FIG. 4 is an exploded view of a major component of the kit, which component is also constructed in accordance with a feature of the present invention.
Figure 5:
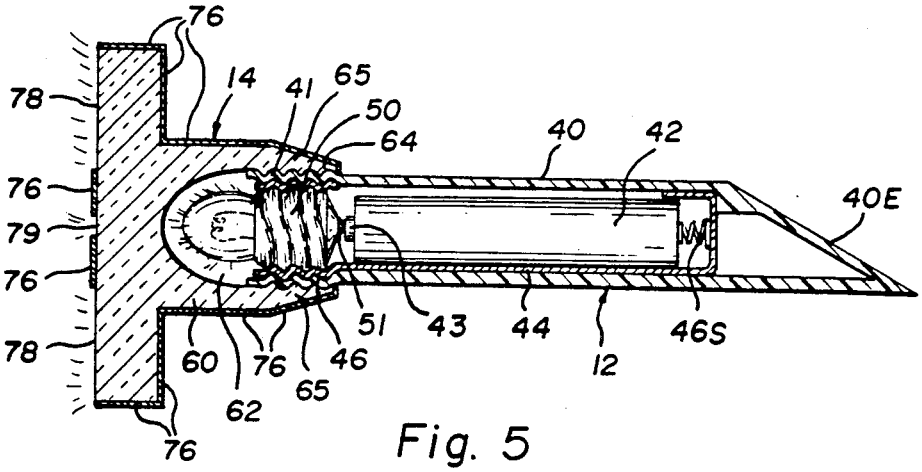
FIG. 5 is a sectional view of the assembled components of FIG. 4 illustrating in more detail the method of construction and interconnection of the parts.

Referring to FIG. 1, there is depicted a kit identified by the number 10 and constructed in accordance with the principles of the present invention. The kit 10 for making a face on a pumpkin or other like head or base unit comprises a number of self-powered illuminating units 12 and a number of largely transparent or translucent facial elements designated by the numbers 14, 16, 18, 20, 22, 24, 26, 28 and 35 and, preferably, a few more-or-less conventional facial elements such as those designated by the numbers 30, 32, 34 and 36. The self-powered units 12 are, as better shown in FIGS. 4 and 5, made of a hollow base 40 made of plastic or other electrical insulating material, an energy storage device, which in this case is a conventional penlight battery 42, a conductive housing 44 preferably made of thin sheet metal which accepts the battery 42 and includes a spring 46 for urging the battery so received forward (FIG. 5) and for electrically connecting the bottom of the battery to the conductive housing 44. The front of the housing 44 is formed into a threaded socket 46 for receiving the threaded base of a conventional light-emitting incandescent flashlight bulb 50. The threaded socket 46 of the housing 44 serves not only to receive and hold the bulb 50 but also, as it is threaded on the outside as well as the inside, to secure the assembled bulb, housing and battery into the hollow base 40, which has conforming threading 41 found at its forward end. This threading 41 exists on both the inside and outside of the forward end of the base 40. The outside threading at 41 serves to secure any one of elements 14, 16, 18, 20, 22, 24 or 26, 28 or 35 or, indeed, any similar elements. These elements are each provided with a rearward projecting socket 60 which has a rearward opening cavity 62 with an internal threading 64 which receives the external threading 41 of the base 40, as shown in FIG. 5. The cavity 62 also serves to receive the glass portion of the bulb 50.

As best shown in FIG. 5, the element 14 is primarily made of a translucent material, preferably plastic, which may be colored so as to emit light of a desired shade such as green or red. The rearward portions of the element 14 are coated with a reflective material 76, preferably a shiny metallic coating, for reflecting light from the bulb 50. Only those portions 78, 79 of the element 14 which are desired to emit light are not coated.

Note should be taken of the fact that the housing 44 and its battery 42 can be inserted and held in the base 40 without inserting the bulb or with the bulb only partly screwed in. Under these circumstances, the bulb will not light until fully screwed in. This may serve as a switch, or else a separate switch (not shown) may be provided. The electric circuit is completed from the negative terminal (bottom) of the battery 42 through the spring 46 and the housing 44, to the threaded terminal of the bulb 50, its filament and the electrically isolated bottom terminal 51 (FIG. 5) of the bulb 50 and the positive terminal 43 of the battery. Therefore, by threading the bulb 50 outward sufficiently to separate the terminals 43 and 51, the circuit is broken and the bulb will not light. By threading in the bulb 50 more fully, the contact is completed and the bulb 50 will light.

Figure 2:
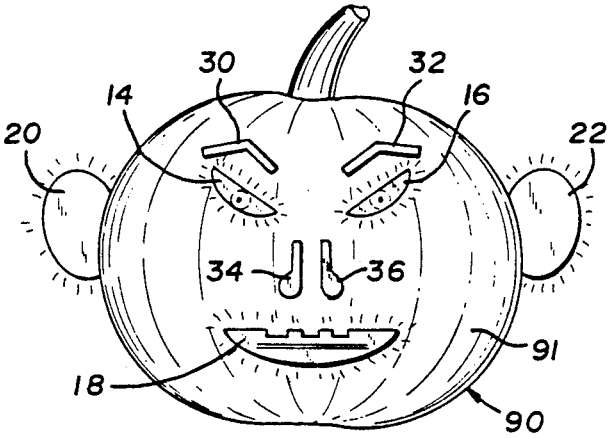
FIG. 2 is an elevational front view of a natural pumpkin jack-o-lantern made using parts from the kit of FIG. 1 and illustrating one use thereof.
Figure 3:
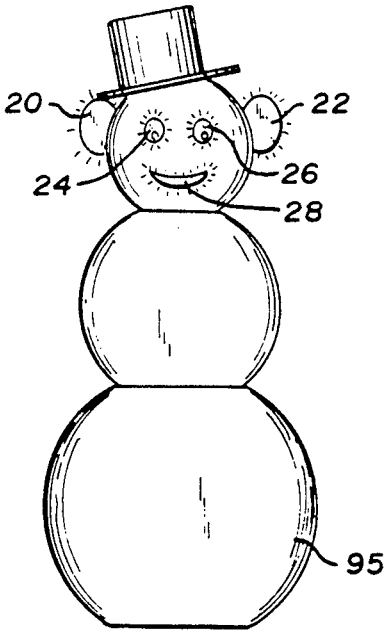
FIG. 3 is an elevational front view of a snowman using illuminated facial features made from parts from the kit of FIG. 1 and also illustrating the versatility of the kit.

The base 40 and the socket 14 are preferably inserted entirely into the head-like member such as the pumpkin of FIG. 2 or snowman of FIG. 3. To this end, the base 40 is made in a spearlike shape and has its extreme end 40E pointed and formed at a sharp angle. Likewise, the socket 60 has a tapering rear end 65, so that the assembly of element 14 (or any like element) and unit 12 can more easily force it way into the pumpkin or like head unit.

When screwed together, the preferably plastic base 40 and plastic element 14 completely enclose the electrical connection and parts and seal out moisture and water therefrom. Thus, the combination of FIG. 5 may be inserted into the wet interior of a pumpkin as shown in FIG. 2 or even into the compacted snow of a natural snowman as shown in FIG. 3 without danger of water or other liquids penetrating it and shorting out the battery 41 or the light bulb 50.

It should be appreciated that the assembly can be removed and reused later and, when the battery 42 is spent, the battery can be changed easily. That is, the assembly can be removed from the pumpkin or like head, opened by screwing off the face element, then unscrewing the bulb 50 and housing 44 from the base 40. Then, the old battery can be removed and a fresh one replaced and the process reversed to reassemble the assembly.

As can be appreciated from FIG. 1, the kit may be provided with a much larger number of illuminated face elements than illuminating units 12, since normally only three to five face illuminated elements are employed. By providing a larger number of elements such as the elements 14, 16, 18, 20, 22, 24, 26 and 28, the user is given more options in making the faces. For example, in making the jack-o-lantern 90 shown in FIG. 2, an uncarved pumpkin 91 has the five illuminating units 12 of FIG. 1 assembled with facial elements 14, 16, 18, 20, 22, and the five assemblies manually pushed into the pumpkin at the positions shown in FIG. 2. The face may be completed by also inserting the non-illuminated elements 30, 32, 34 and 36 as shown.

Alternatively, the user may select to use elements 20, 22, 24, 26 and 28 with the unit 12 and to decorate the face of the snowman 95 of FIG. 3 and produce an illuminated featured snowman—which, especially at night, would provide a novel appearance.

While one particular embodiment of the invention has been shown and described, it will be obvious to those skilled in the art that changes and modifications may be made without departing from the invention and, therefore, the aim in the appended claims is to cover all such changes and modifications as fall within the true spirit and scope of the invention.

I claim:

1. A kit of parts for creating a face on a head-like base such as a pumpkin or snowman's head, having illuminated face elements comprising:

a plurality of self-powered illuminating elongated insert units having a pointed end for inserting into the base and an opposite end, means for emitting light from said opposite end, and means for allowing face elements to be attached to said opposite end, so as to be illuminated by said light emitting means; and a plurality of face elements such as ears, eyes, mouths, or noses, each of which element is constructed of material such that it may be illuminated when attached to one said self-powered illuminating insert unit and each of which elements having means for securely attaching itself to one of said insert units to thereby form a illuminated face element assembly;

whereby selected ones of said plurality of said face elements may be securely attached to said self-powered illuminating inserts and said assembly then inserted into the base so as to create a face thereon with illuminated or glowing elements.

2. The kit of claim 1 wherein:

each of said plurality of self-powered illuminating inserts includes a battery and means coupling electric power for said battery to said means for emitting light at said opposite end and includes means for electrically insulating said battery, said light emitting means and said means for coupling from the base and from external liquids or moisture.

3. The kit of claim 2, wherein said means for insulating is primarily an electrically insulating hollow housing which forms the outside of the insert and forms it pointed end.

4. The kit of claim 3, wherein said housing is of plastic and encloses the battery and coupling means.

5. The kit of claim 4, wherein said face elements are of electrically insulating material and serve with said housing to enclose and seal from external moisture and liquids said battery connecting means and light-emitting means.

6. An illuminated facial element assembly for use with a head-like base comprising:

self-powered light-emitting means;

a translucent facial element coupled to receive the light from said light-emitting means and to pass such light out through selected surface areas of said element affixed to said self-powered light-emitting means to form an assembly therewith; and means for releasably but securely affixing the assembly to the head-like base.

7. The assembly of claim 6 wherein said self-powered light-emitting means comprises an electric battery coupled to a light emitter.

8. The assembly of claim 7 wherein said light emitter is a light bulb and said battery is a cylindrical penlight battery, said assembly includes an elongated generally outwardly smooth housing base for said battery which has a spear-shaped rear end and a front end at which said light bulb is positioned and said shaped housing serves as said means for affixing the assembly to the head-like base.

* * * * *